US006415765B1

(12) United States Patent
Akagi et al.

(10) Patent No.: US 6,415,765 B1
(45) Date of Patent: Jul. 9, 2002

(54) THROTTLE UNIT OF ENGINE

(75) Inventors: Takashi Akagi; Takashi Udono, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/949,801

(22) Filed: Sep. 12, 2001

(30) Foreign Application Priority Data

Sep. 12, 2000 (JP) ..... 2000-277191

(51) Int. Cl.[7] ..... F02D 9/08; F02B 75/15
(52) U.S. Cl. ..... 123/336; 123/585
(58) Field of Search ..... 123/339.22, 336, 123/585, 339.23, 580, 59.5

(56) References Cited

U.S. PATENT DOCUMENTS 5,181,491 A * 1/1993 Izumi et al. ..... 123/336
5,979,388 A * 11/1999 Akagi et al. ..... 123/179.18

* cited by examiner

*Primary Examiner*—Andrew M. Dolinar
*Assistant Examiner*—Johnny Hoang
(74) *Attorney, Agent, or Firm*—Birch, Stewart, Kolasch & Birch, LLP

(57) ABSTRACT

A bypass passage includes an inlet in communication with the upstream sides of first and second throttle valves of first and second suction passages. One valve body receiving chamber is coaxial with the inlet. First and second upstream side branch passages extend from the valve body receiving chamber. Downstream side branch passages extend from the end portions of the upstream side branch passages and are in communication with the downstream sides of the first and second throttle valves of the first and second suction passages. One bypass valve is movably received in the valve body receiving chamber and can open the first and second upstream side branch passages to be at the same opening. Reducing the number of bypass valves to one can reduce the manufacturing costs and the number of man hours for assembly of the throttle unit and can equalize the rate of air flowing through the respective bypass passages.

16 Claims, 7 Drawing Sheets

THROTTLE UNIT OF ENGINE

BACKGROUND OF THE INVENTION

1. Field of the Invention

The present invention relates to a throttle unit having a reduced manufacturing cost and a reduced number of man hours for assembly. Furthermore, the present invention relates to a throttle unit which is suitable for equalizing the amount of air passing through the bypass passages of the throttle valves, a bypass passage being provided for each throttle valve.

2. Description of Background Art

A throttle unit for an engine has been disclosed in Japanese Patent No. 2723990 entitled "THROTTLE BODY FOR MULTIPLE-CYLINDER COMBUSTION ENGINE." In the above document, a throttle unit is provided with a fast idling mechanism. The fast idling mechanism includes a valve for opening or closing a bypass passage for bypassing a throttle valve. The valve is provided in the bypass passage. Furthermore, when the engine is started, the valve is opened to supply air to the combustion chamber of the engine via the bypass passage to increase the number of revolution of the engine during idling to prevent the engine from unstably rotating during idling or stopping.

FIGS. 5 and 6 of the above document have been reproduced as FIGS. 7 and 8 of the present invention, respectively. In addition, for the sake of convenience, FIG. 7 of the present invention includes a portion of FIG. 4 of the above document, and FIG. 8 of the present invention includes a main portion of FIG. 6 of the above document. Furthermore, the reference numerals in FIGS. 7 and 8 of the present invention do not correspond to the reference numerals in the above document.

FIG. 7 is a first cross-sectional view of a throttle unit according to the background art which shows a state in which a throttle body 100 is provided with suction passages 101, 102, and in which the respective suction passages 101, 102 are provided with throttle valves 103, (not shown), respectively. Furthermore, the upstream side of the throttle valve 103 of one suction passage 101 is in communication with the downstream side of the throttle valve 103 of the suction passage 101 by a common bypass suction passage hole 105 and a bypass suction passage hole 106 for controlling the idling speed. The bypass suction passage hole 106 is connected to the common bypass suction passage 105. Furthermore, an idling speed control valve 107 for opening or closing the bypass suction passage hole 106 is disposed at the inlet of the bypass suction passage hole 106.

FIG. 8 is a second cross-sectional view of the throttle unit according to the background art. FIG. 8 shows a state in which a bypass suction passage hole 108 for controlling the idling speed is branched from the common bypass suction passage hole 105 (see FIG. 7) and is in communication with the downstream side of the throttle valve (not shown) of the suction passage 102. An idling speed control valve 111 for opening or closing the bypass suction passage hole 108 is disposed at the inlet of the bypass suction passage hole 108. Operating levers 112, 112 are secured to the end portions of the idling speed control valves 107, 111. Furthermore, a link shaft 113 for opening or closing the idling speed control valves 107, 111 in one operation is mounted to the operating levers 112, 112.

According to the above-mentioned technology, idling speed control valves 107, 111 are provided for each of the bypass suction passage holes 106, 108. Therefore, in addition to the idling speed control valves 107, 111, operating levers 112, 112 and parts relating to these valves are required. This increases the number of parts and therefore the number of man hours for assembly and the manufacturing costs of the throttle unit are increased.

Furthermore, since the plurality of idling speed control valves 107, 111 are opened or closed by one link shaft 113 via the operating levers 112, 112, depending on the variation in the size of the idling speed control valves 107, 111, the operating levers 112, and the link shaft 113, there is the possibility that a difference in the opening of the idling speed control valves 107, 111 may be produced to make the amount of air passing through the respective bypass suction passage holes 106 different from the amount of air passing through the respective bypass suction passage holes 108. Accordingly, the number of revolution of the engine during idling may become unstable.

SUMMARY OF THE INVENTION

For the above reason, the object of the present invention is to reduce the manufacturing costs and the number of man hours for assembly of the throttle unit of an engine and to equalize the amount of air passing through the bypass passages for each of the throttle valves.

In order to accomplish the object described above, according to a first aspect of the present invention, in a throttle unit of an engine including suction passages from an air cleaner to the respective combustion chambers of a multiple-cylinder engine, throttle valves disposed in the respective suction passages, and bypass passages bypassing the throttle valves, the bypass passage includes an inlet of the bypass passage communicating with the upstream side of the throttle valve of the suction passage, one valve body receiving chamber coaxial with the inlet of the bypass passage, a plurality of upstream side branch passages extending from the valve body receiving chamber, downstream side branch passages extending from the end portions of the upstream side branch passages and communicating with the downstream sides of the throttle valve of the suction passage, one valve body which is movably received in the valve body receiving chamber and is moved in the valve body receiving chamber in the direction away from the inlet of the bypass passage to open the plurality of upstream side branch passages at the same opening when opening the bypass passage.

In the throttle unit according to the background art, a bypass passage for bypassing a throttle valve is disposed in each suction passage sending air into the combustion chamber of each cylinder and a valve for opening or closing the bypass passage is disposed at each bypass passage and a link mechanism is disposed at each valve to activate the valve. For this reason, in the throttle unit according to the background art, the number of parts increases and the manufacturing cost and the number of man hours for assembly of the throttle unit increase. However, according to the-present invention, a mechanism for activating the bypass valve can be simplified by reducing the number of the bypass valves of the multiple-cylinder engine to one. This can reduce the manufacturing costs and the number of man hours required for assembly of the throttle unit.

Furthermore, during the control of the opening or closing of the bypass passage by one valve body in the throttle unit according to the background art, suction air tends to be sucked into one cylinder from the other cylinder by a difference in negative pressure between the respective cylinders. However, by controlling the opening of each of the plurality of upstream side branch passages to be at the same opening, it is possible to make the total sum of the opening areas of the upstream side branch passages smaller than the passage area of the inlet side of the bypass passage at a time when the number of revolutions of the engine is not more than 2000 rpm and tends to vary widely.

Accordingly, it is possible to prevent the suction air from being sucked into one cylinder from the other cylinder and therefore prevent a variation in the number of revolutions of the engine. Therefore, it is possible to control the number of revolutions of the engine during idling with a high accuracy.

According to a second aspect of the present invention, the plurality of upstream side branch passages are formed on a line crossing at right angles and passing through the valve body receiving chamber.

The plurality of upstream side branch passages can be easily formed in one machining step to reduce the time and cost of machining.

According to a third aspect of the present invention, the valve body receiving chamber has a diameter larger than the inlet of the bypass passage. Furthermore, the valve body is butted against a step-wise portion between the valve body receiving chamber and the inlet of the bypass passage to completely close the bypass passage.

The above-mentioned construction according to the third aspect of the present invention can minimize the amount of air leakage when all of the bypass passages are closed and can more correctly conduct suction control except when the engine is being started.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
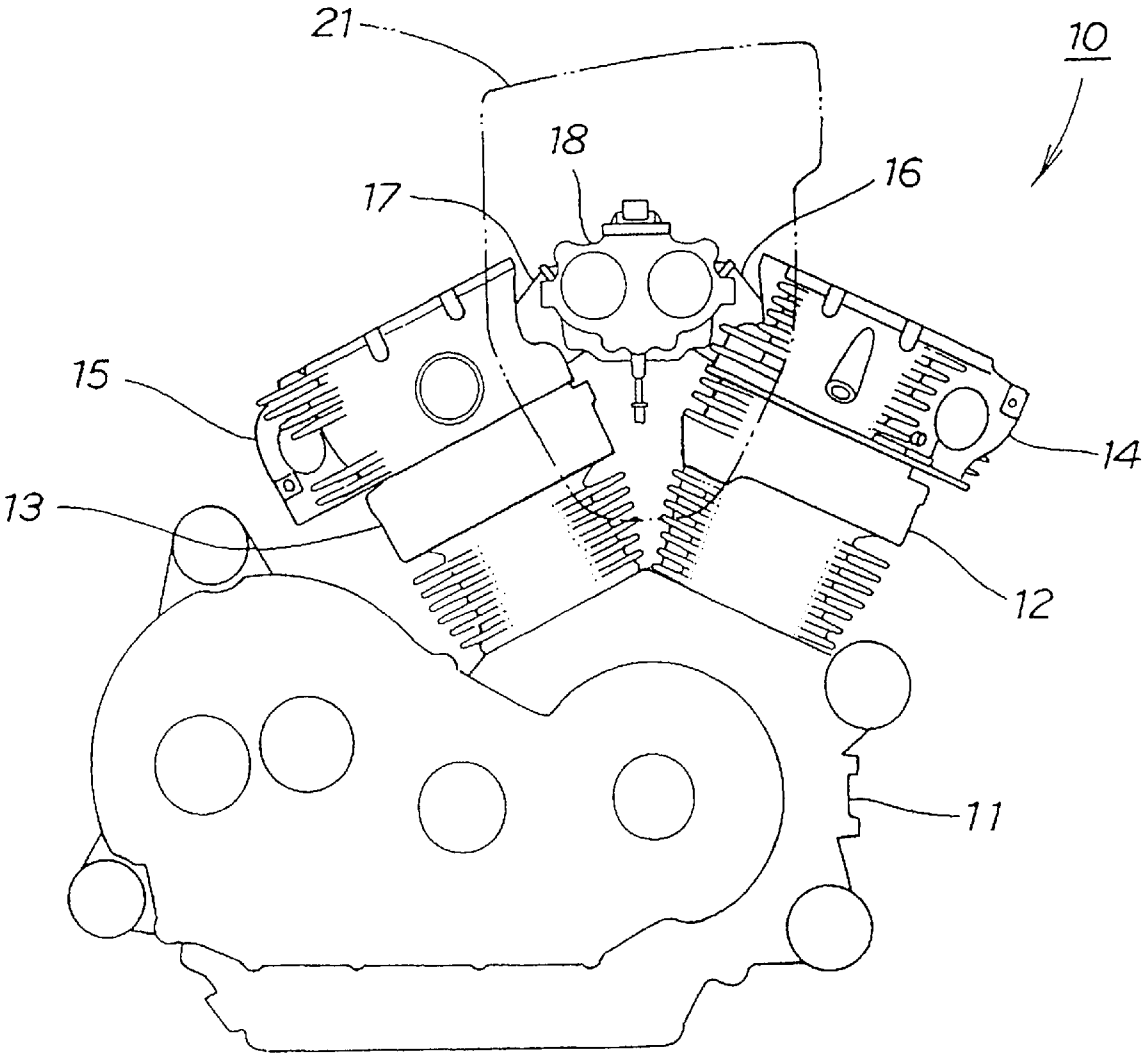
FIG. 1 is a side view of an engine provided with a throttle unit in accordance with the present invention.

Preferred embodiments in accordance with the present invention will hereinafter be described in detail with reference to the accompanying drawings. The same reference numerals have been used throughout the several views to identify the same or similar elements. Furthermore, the drawings should be viewed in the direction of orientation of the reference numerals.

FIG. 1 is a side view of an engine provided with a throttle unit in accordance with the present invention. An engine 10 is a V-type two-cylinder engine having a first cylinder block 12 and a second cylinder block 13 which are mounted on the top of a crank case 11. A first cylinder head 14 and a second cylinder head 15 are mounted on the first and second cylinder blocks 12, 13, respectively. A throttle unit 18 is interposed between the first and second cylinder heads 14, 15 via a first suction or intake manifold 16 and a second suction or intake manifold 17. Furthermore, an air cleaner 21 is mounted on the throttle unit 18.

The first cylinder block 12 and the first cylinder head 14 are on the first cylinder side and the second cylinder block 13 and the second cylinder head 15 are on the second cylinder side.

Figure 2:
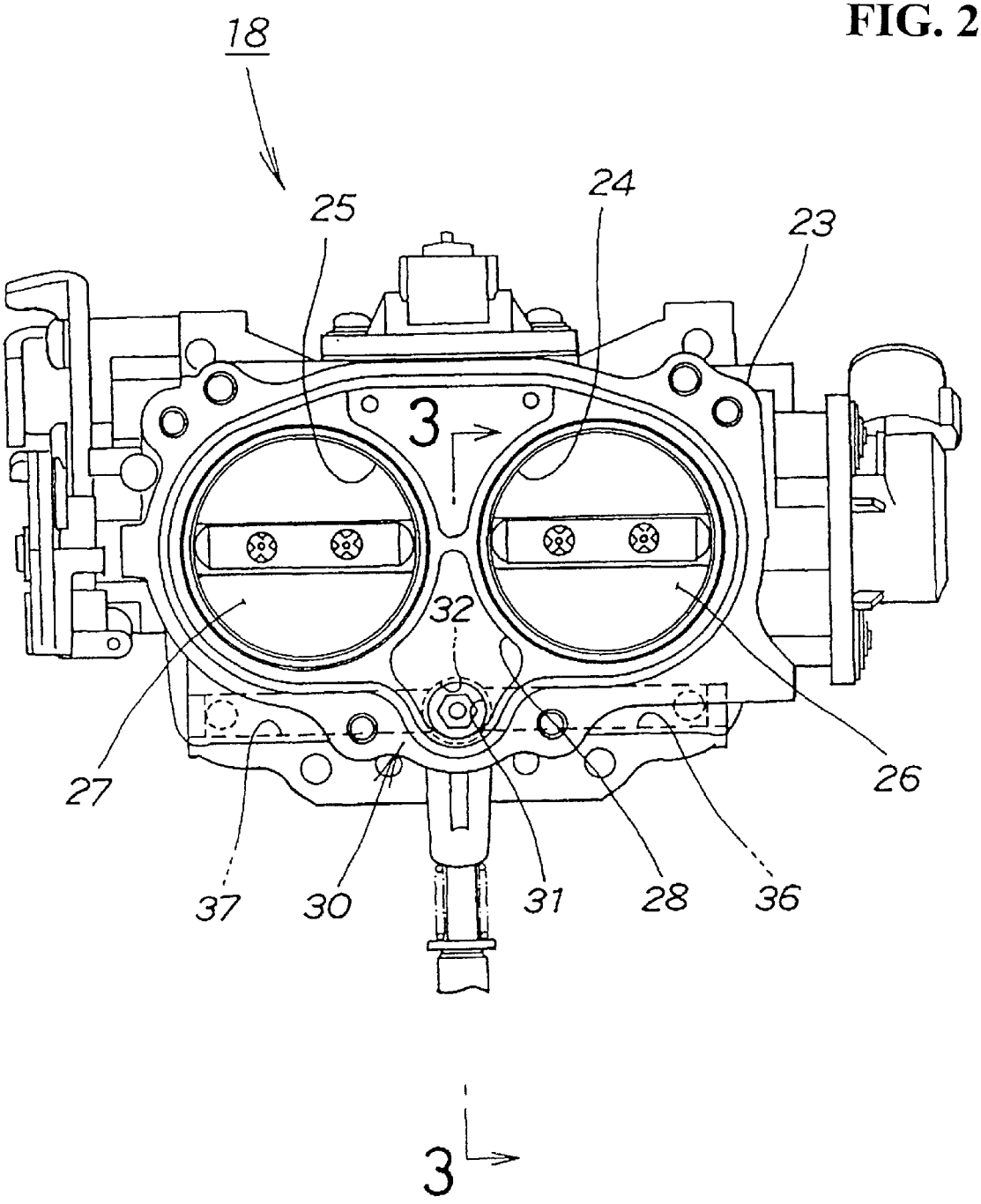
FIG. 2 is a front view of a throttle unit in accordance with the present invention.

FIG. 2 is a front view of the throttle unit in accordance with the present invention. A first suction passage 24 in communication with the combustion chamber of the first cylinder head 14 (see FIG. 1) and a second suction passage 25 in communication with the combustion chamber of the second cylinder head 15 (see FIG. 1) are formed in the throttle body 23 of the throttle unit 18. A first throttle valve 26 for controlling the rate of air passing through the first suction passage 24 is mounted in the first suction passage 24. A second throttle valve 27 for controlling the rate of air passing through the second suction passage 25 is mounted in the second suction passage 25. A depressed portion 28 is formed in the front of the throttle body 23 (at the side of the air cleaner 21 (see FIG. 1)). An inlet 31 of a bypass passage 30 (to be described in detail below) for air bypassing the first and second throttle valves 26, 27 is formed in the depressed portion 28.

Figure 3:
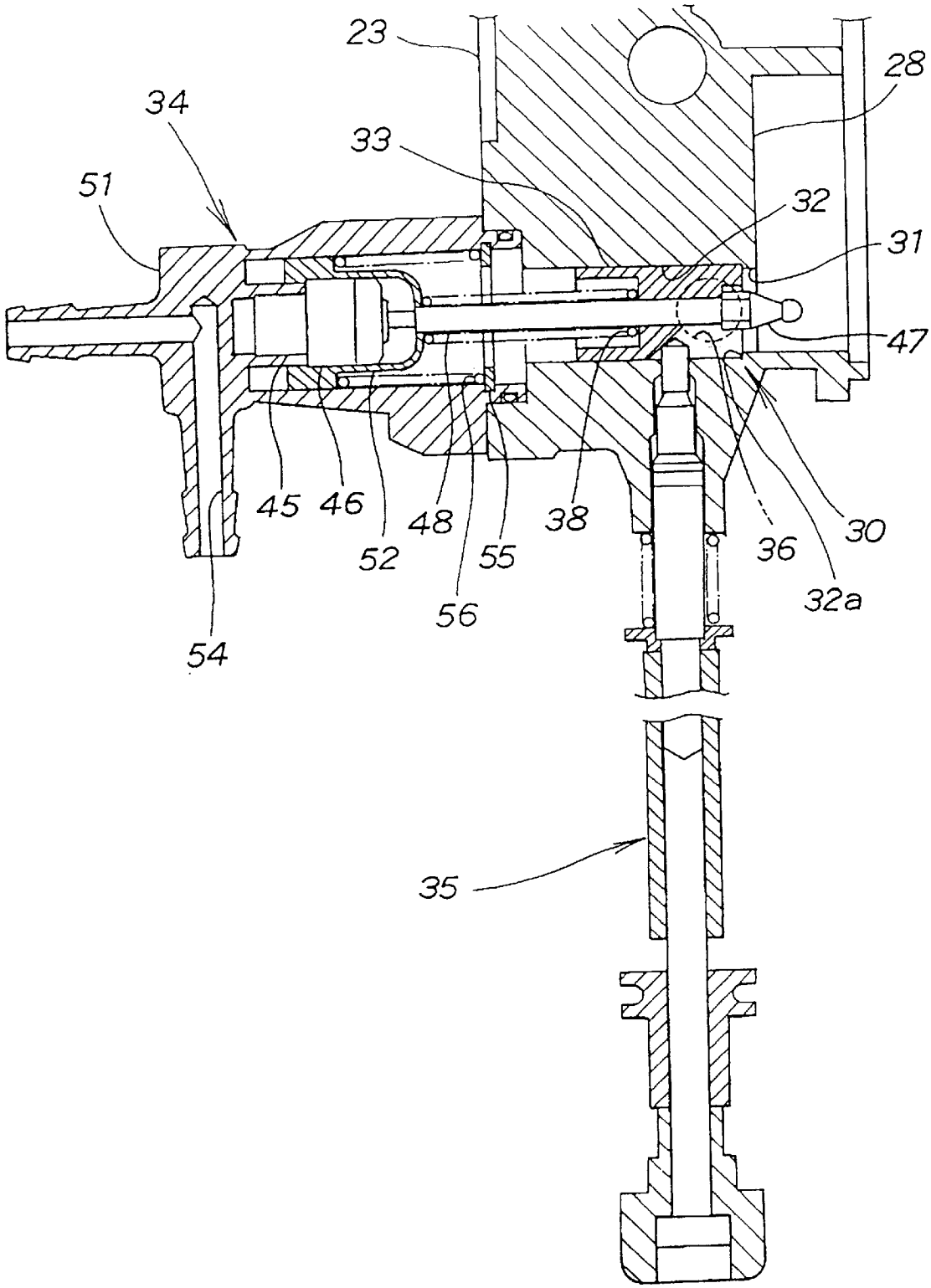
FIG. 3 is a cross-sectional view taken on a line 3—3 of FIG. 2.

FIG. 3 is a cross-sectional view taken on a line 3—3 in FIG. 2. A valve body receiving chamber 32 extending to the inlet 31 of the bypass passage 30 is formed in the throttle body 23. The valve body receiving chamber 32 receives a bypass valve 33 which acts as a valve body for opening or closing the bypass passage 30. The bypass valve 33 can move within the valve body receiving chamber 32. Furthermore, a valve body driving mechanism 34 which operates from the expansion or contraction of wax caused by a change in the temperature of the cooling water of the engine is fixed to the bypass valve 33.

In FIG. 3, reference numeral 35 designates a valve adjusting mechanism for manually adjusting the opening of the bypass valve 33 and reference numeral 36 designates a first upstream side branch passage in communication with the valve body receiving chamber 32. In FIG. 2, the first upstream side branch passage 36 is disposed at the right side of the valve body receiving chamber 32 and a second upstream side branch passage 37 in communication with the valve body receiving chamber 32 is disposed at the left side of the valve body receiving chamber 32. In FIG. 3, the inlets of the first and second upstream side branch passages 36, 37 (reference numeral 37 is not shown) are closed by the first bypass valve 33.

The valve body receiving chamber 32 is coaxial with the inlet 31 and has a diameter larger than the inlet 31. The bypass valve 33 is pressed on the end portion 32*a* of the inlet 31 side of the valve body receiving chamber 32 by a spring 38 to completely close the bypass passage 30. The end portion 32*a* is an annular step-wise portion formed by the inlet 31 and the valve body receiving chamber 32.

The valve body driving mechanism 34 includes a wax-filled portion 45 which is filled with wax, a cylinder portion 46 for receiving a piston (not shown) which is movable by the expansion or contraction of the wax, a rod 48 fixed to the piston and including the bypass valve 33 mounted at a tip thereof by a nut 47, a case 51 mounted on the throttle body 23 so as to receive the wax-filled portion 45 and the cylinder portion 46, a sub-case 52 interposed between the case 51 and the cylinder portion 46, and the spring 38 interposed between the sub-case 52 and the bypass valve 33. Reference numeral 54 designates a cooling water passage for flowing engine cooling water, reference numeral 55 designates a stop ring, and reference numeral 56 designates a spring for preventing the sub-case 52 from withdrawing.

Figure 4:
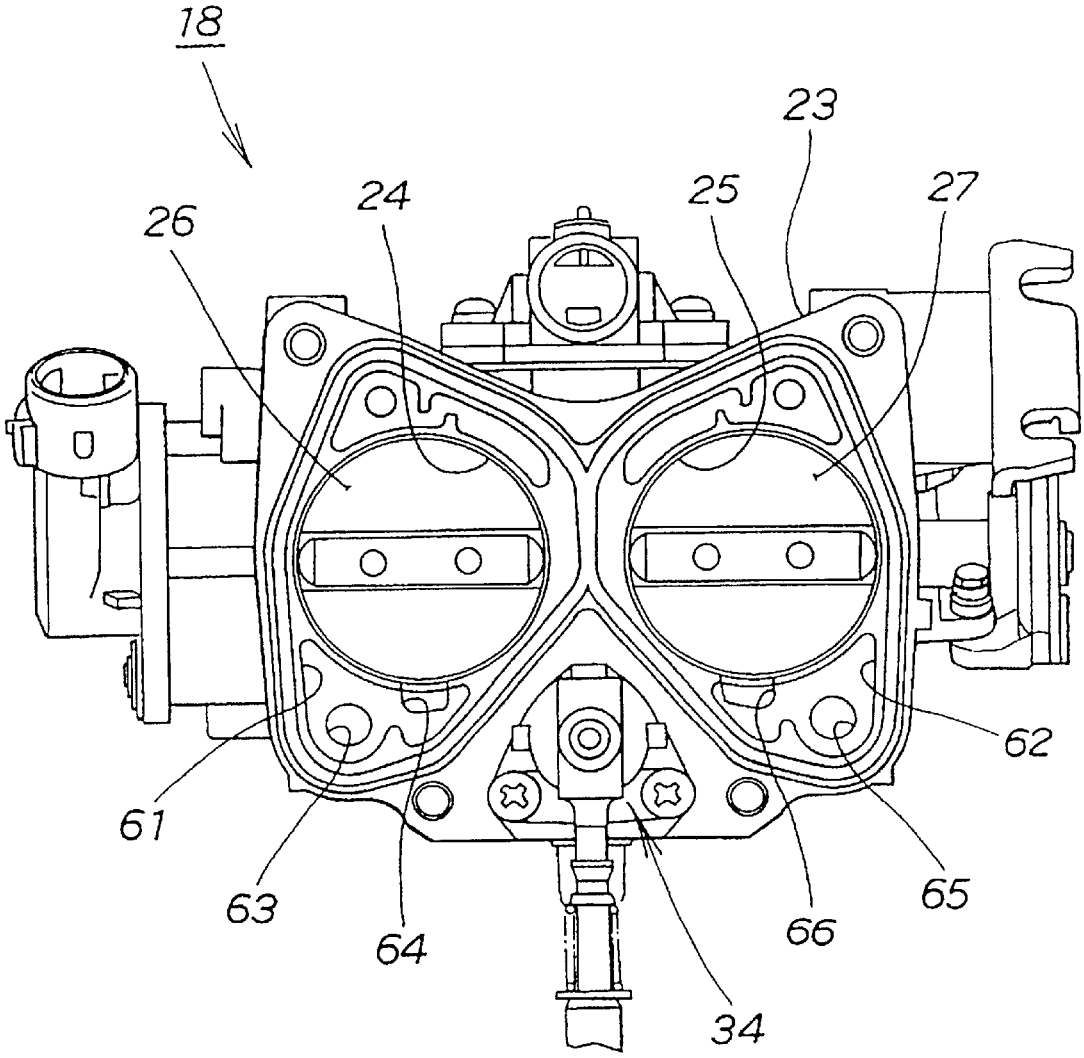
FIG. 4 is a rear view of a throttle unit in accordance with the present invention.

FIG. 4 is a rear view of the throttle unit in accordance with the present invention. Depressed portions 61, 62 are formed at the back (at the side of the first and second suction manifolds 16, 17 (see FIG. 1)) of the throttle body 23. The outlet of a first downstream side branch passage 63 in communication with the first upstream side branch passage 36 (see FIG. 2) is formed in the depressed portion 61. The depressed portion 61 is in communication with the first suction passage 24 by a groove 64. The outlet of a second downstream side branch passage 65 in communication with the second upstream side branch passage 37 (see FIG. 2) is formed in the depressed portion 62. The depressed portion 62 is in communication with the second suction passage 25 by a groove 66. The first suction manifold 16 is connected to the first suction passage 24 and the second suction manifold 17 is connected to the second suction passage 25.

Figure 5:
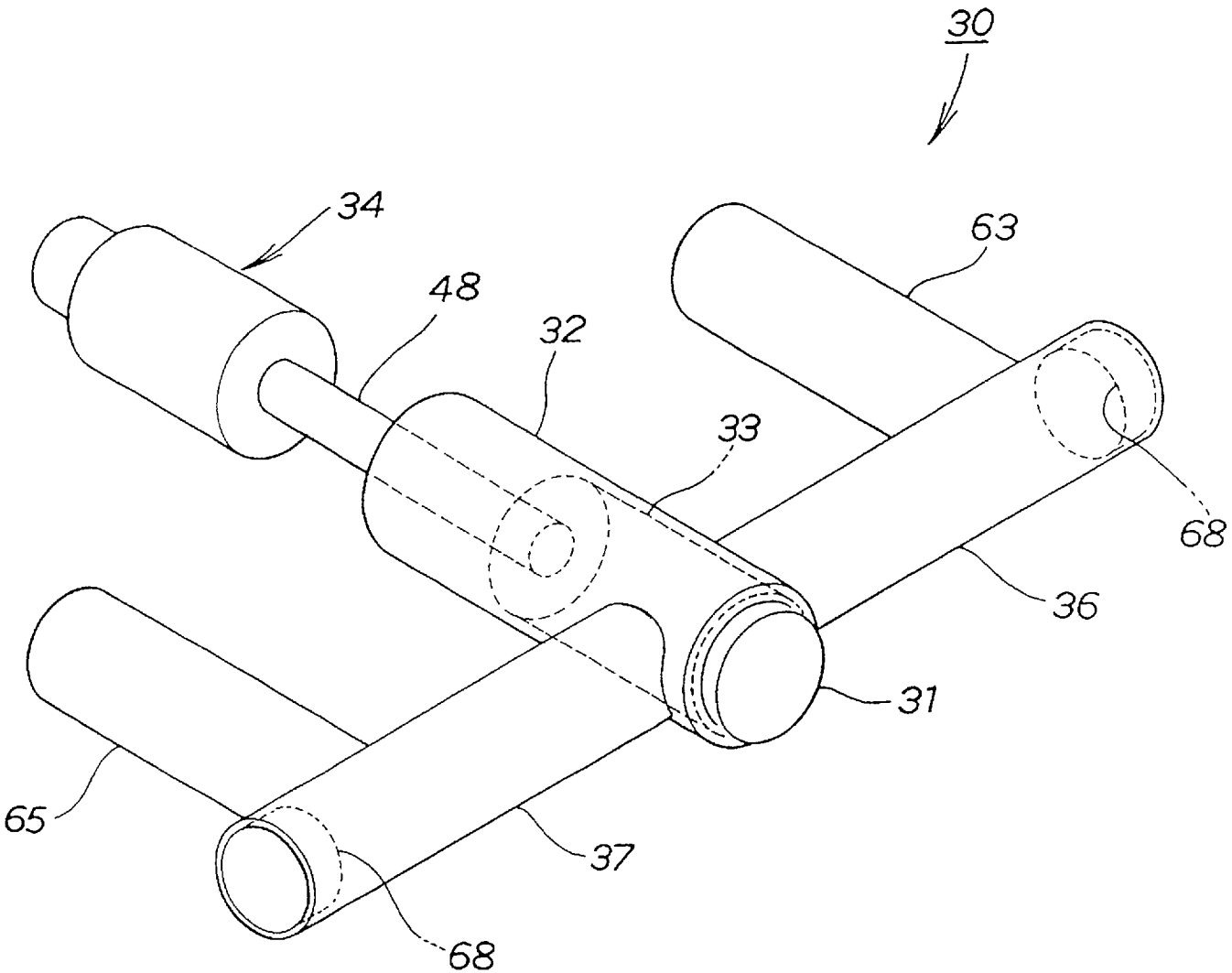
FIG. 5 is a perspective view illustrating a bypass passage of a throttle unit in accordance with the present invention.

FIG. 5 is a perspective view illustrating the bypass passage of the throttle unit in accordance with the present invention. The bypass passage 30 includes the inlet 31 communicating with the upstream sides of the first and second throttle valves 26, 27 (see FIG. 4). For example, the inlet 32 communicates with the inside of the first and second suction passages 24, 25 (see FIG. 4) or the inside of the air cleaner 21 (see FIG. 1). The bypass passage also includes one valve body receiving chamber 32 which is coaxial with the inlet 31 and has a diameter larger than the inlet 31. First and second upstream side branch passages 36, 37 extend from the valve receiving chamber 32. The first and second downstream side branch passages 63, 65 extend from the end portions of the first and second upstream side branch passages 36, 37 and are in communication with the downstream sides of the first and second throttle valves 26, 27 of the first and second suction passages 24, 25. Furthermore, one bypass valve 33 is movably received in the valve body receiving chamber 32 and can be pressed on the end portion of the inlet 31 side of the valve receiving chamber 32 when closing the bypass passage 30. The bypass valve 33 can be moved in the valve body receiving chamber 32 in the direction that is away from the inlet 31 when opening the bypass passage 30. Reference numerals 68, 68 designate plugs for closing the first and second upstream side branch passages 36, 37.

As described above, the present invention includes a plurality of first and second upstream side branch passages 36, 37 formed on a line crossing at right angles and passing through the valve body receiving chamber 32.

According to the above construction, it is possible to form the plurality of first and second upstream side branch passages 36, 37 in one machining step. Accordingly, the cost and time of machining can be reduced.

Furthermore, since the valve body receiving chamber 32 is formed coaxially with the inlet 31, it is possible to machine the inlet 31 and the valve body receiving chamber 32 without changing the positioning of the throttle unit 18 (see FIG. 1) on a machine tool during machining. Accordingly, the time and cost of machining can further be reduced.

The action of the bypass passage 30 described above will now be described hereinbelow.

Figure 6A:
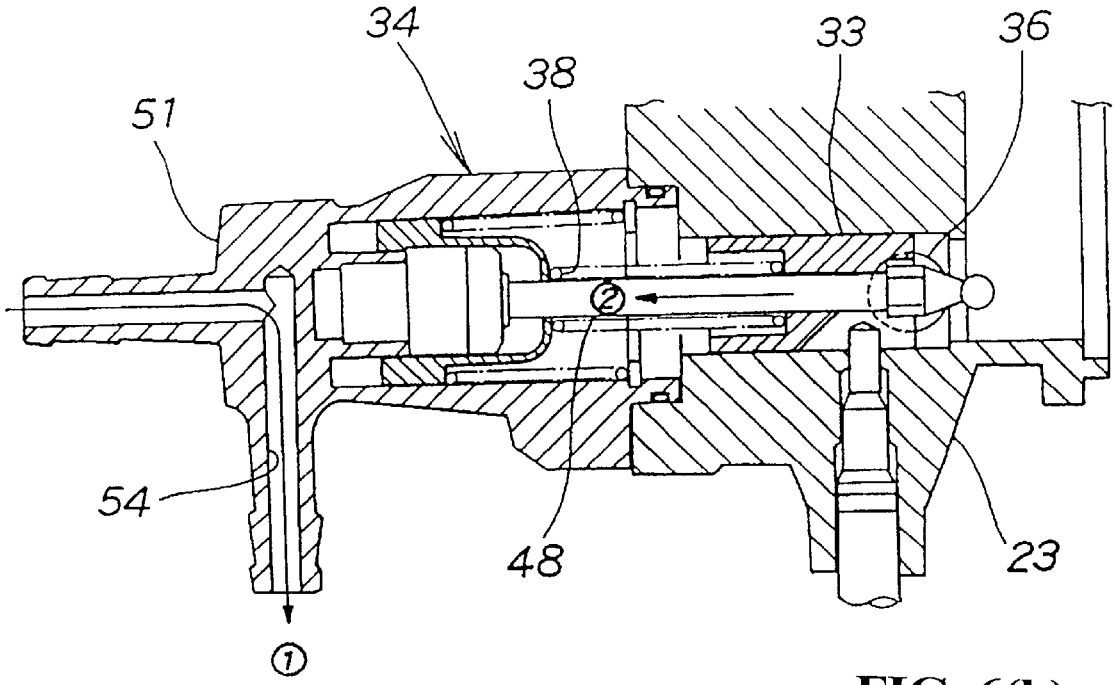
FIG. 6(*a*) and 6(*b*) are views illustrating the action of a bypass passage of a throttle unit in accordance with the present invention.
Figure 6B:
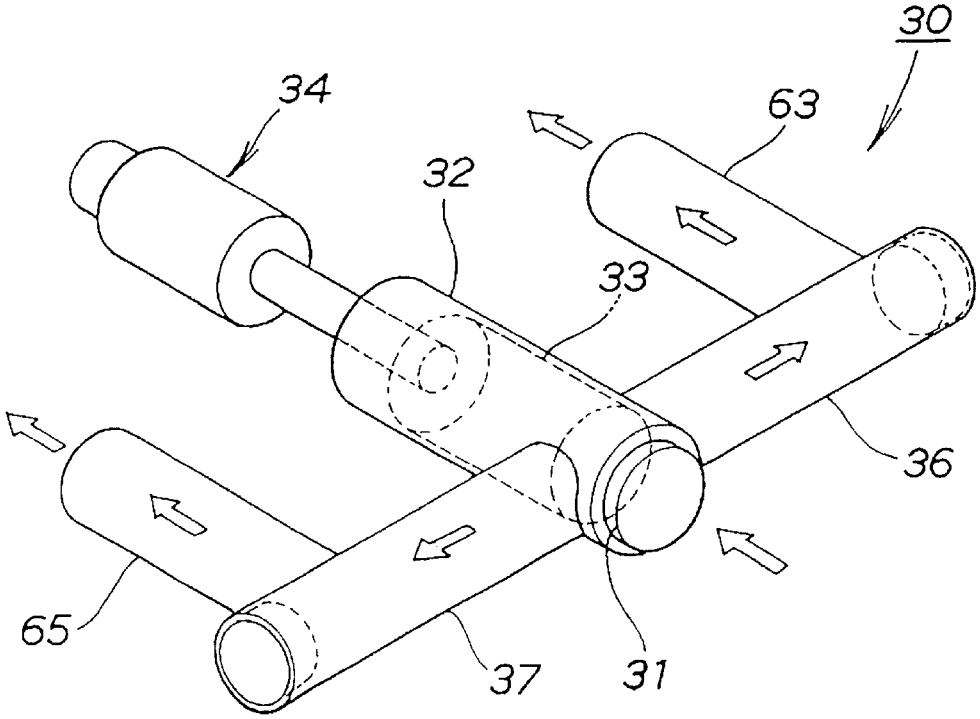
Figure 7:
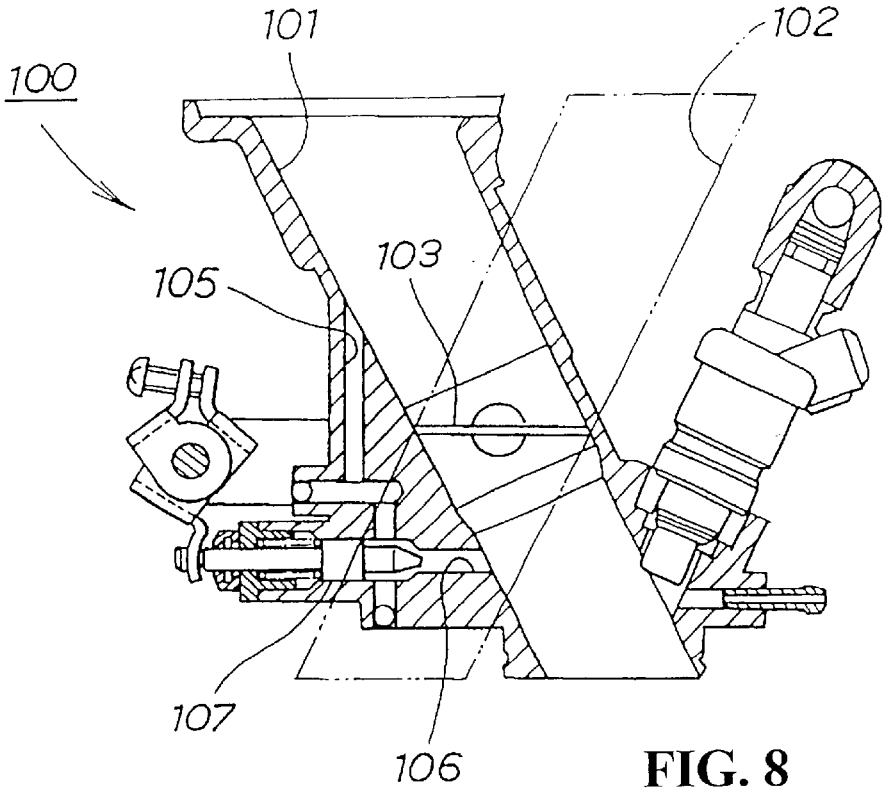
FIG. 7 BACKGROUND ART
FIG. 7 is a first cross-sectional view of a throttle unit according to the background art.
Figure 8:
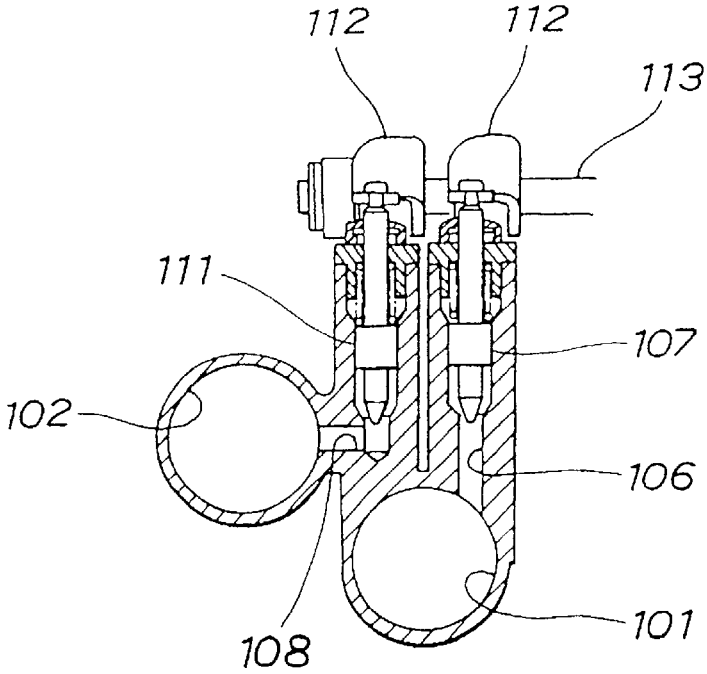
FIG. 8 BACKGROUND ART
FIG. 8 is a second cross-sectional view of a throttle unit according to the background art.

FIGS. 6(*a*) and 6(*b*) are views illustrating the action of the bypass passage of the throttle unit in accordance with the present invention.

In FIG. 6(*a*), when the engine is started, engine cooling water having a low temperature flows in the cooling water passage 54 as shown by an arrow ①.

The flow of cooling water contracts the wax in the valve body driving mechanism 34 and therefore pulls the bypass valve 33 in the direction shown by an arrow ② against the elastic force of the spring 38 via the piston (not shown) and the rod 48. As a result, the inlets of the first and second upstream side branch passages 36, 37 (reference numeral 37 is not shown) are opened.

In FIG. 6(*b*), when the inlets of the first and second upstream side branch passages 36, 37 are opened, the suction air flows from the upstream sides of the first and second throttle valves 26, 27 through the inlet 31 into the valve body receiving chamber 32, as shown by arrows, and branches from the valve body receiving chamber 32 into the first upstream side branch passages 36 and the second upstream side branch passages 37. Furthermore, the suction air 37 flows from the first upstream side branch passage 36 into the first downstream side branch passage 63 and from the second upstream side branch passage 37 into the second downstream side branch passage 65 and flows from the first and second downstream side branch passages 63, 65 into the downstream sides of the first and second throttle valves 26, 27 to bypass the first and second throttle valves 26, 27.

Therefore, the amount of air supplied to the respective combustion chambers of the first and second cylinders in a state where the first and the second throttle valves 26, 27 are closed is increased. Accordingly, the number of revolutions of the engine during idling can be increased.

In addition, in FIG. 6(*a*), when the temperature of the engine cooling water passing through a cooling water passage 54 increases, the wax in the valve body driving mechanism 34 is expanded and the elastic force of the spring 38 is added thereto to push the bypass valve 33 in the direction opposite to the arrow ② via the piston (not shown) and the rod 48 to decrease the opening of the inlets of the first and the second upstream side branch passages 36, 37. Accordingly, the rate of flow of air passing through the bypass passage 30 is gradually decreased.

Furthermore, when the temperature of the engine cooling water exceeds a predetermined value, the bypass valve 33 completely closes the inlets of the first and second upstream side branch passages 36, 37.

As shown in FIG. 1, FIG. 2, and FIG. 5, the present invention is directed to the throttle unit 18 of a multiple-cylinder engine 10 including the first and second suction passages 24, 25 extending from the air cleaner 21 to the respective combustion chambers of the engine 10. The first and second throttle valves 26, 27 are disposed in the respective first and second suction passages 24, 25. The bypass passage 30 are for bypassing the first and second throttle valves 26, 27. The bypass passage 30 includes the inlet 31 in communication with the upstream sides of the first and second throttle valves 26, 27 of the first and second suction passages 24, 25, one valve body receiving chamber 32 coaxial with the inlet 31, the first and second upstream side branch passages 36, 37 extending from the valve body receiving chamber 32, and the first and second downstream side branch passages 63, 65 extending from the end portions of the first and second upstream side branch passages 36, 37 and in communication with the downstream sides of the first and second throttle valves 26, 27 of the first and second suction passages 24, 25. Furthermore, one bypass valve 33 is movably received in the valve body receiving chamber 32. The bypass valve 33 is movable in the valve body receiving chamber 32 in the direction away from the inlet 31 to open the first and second upstream side branch passages 36, 37 at the same opening when the bypass passage 30 is opened.

In a throttle unit according to the background art, a bypass passage for bypassing a throttle valve is disposed in each suction passage for sending air into the combustion chamber of each cylinder. A valve for opening or closing each bypass passage is disposed at each bypass passage and a link mechanism is disposed at each valve to activate the valve. For this reason, in the throttle unit according to the background art, the number of man hours for assembly and the number of parts increase. Accordingly, the time and cost of manufacture of the throttle unit increases. However, according to the present invention, a mechanism for activating the bypass valve 33 can be simplified by reducing the number of bypass valves 33 of the multiple-cylinder engine 10 to one. Accordingly, the manufacturing cost and the number of man hours for assembly of the throttle unit 18 can be recuded.

In addition, during the control of the opening or closing of the bypass passage by one valve body in the throttle unit according to the background art, suction air tends to be sucked into one cylinder from the other cylinder due to a difference in negative pressure between the cylinders. Specifically, in addition to the flow of air from the upstream side of the valve body to the respective branch passages, air tends to flow from one branch passage into the other branch passage. However, according to the present invention, it is possible to control the opening of each of the first and second upstream side branch passages 36, 37 to be at the same opening with the use of one bypass valve 33.

Therefore, it is possible to make the total sum of the opening areas of the first and second upstream side branch passages 36, 37 smaller than the passage area of the inlet 31 side of the bypass passage at a time where the number of revolution of the engine is no more than 2000 rpm and tends to vary widely. Accordingly, air can easily flow from the inlet 31 side of the bypass passage to the first and second upstream side branch passages 36, 37. Furthermore, air resists flowing from the first upstream side branch passage 36 to the second upstream side branch passage 37 or from the second upstream side branch passage 37 to the first upstream side branch passage 36.

In this manner, it is possible to prevent suction air from being sucked into one cylinder from the other cylinder, and to reduce the effect on the variation in the number of revolutions of the engine. Furthermore, the air flow between the side of the first upstream side branch passage 36 and the first downstream side branch passage 63 and the side of the second upstream side branch passage 37 and the second downstream branch passage 65 is equalized. Therefore, it is possible to control the number of revolutions of the engine during idling with high accuracy.

Furthermore, the present invention includes the valve body receiving chamber 32 having a diameter larger than the inlet 31 of the bypass passage. The bypass valve 33 is butted against the end portion 32*a* (see FIG. 3) between the valve body receiving chamber 32 and the inlet 31 of the bypass passage to completely close the bypass passage 30.

The above construction can minimize the amount of air leakage from the end portion 32*a* and the bypass valve 33 when the bypass passage 30 is completely closed and can more correctly conduct suction air control except when the engine is being started.

In this connection, while the throttle unit in accordance with the present invention has been applied to the V-type two-cylinder engine, it is not intended to limit the present invention to this preferred embodiment, but the present invention can be applied to a V-type engine having four or more cylinders and a straight type engine or horizontal opposed-cylinder engine having two or more cylinders. In this case, inlets of the upstream side branch passages corresponding to the number of cylinders (number of bypass passages) are formed in the valve body receiving chamber of the present invention.

Furthermore, while the valve body driving mechanism 34 utilizing the expansion or contraction of wax caused by a change in the temperature of the engine cooling water is provided at the bypass valve 33 in the preferred embodiment in accordance with the present invention, it is also possible to adopt a valve body control using a step motor or the like instead of the wax or a manual operation of the valve body by the use of a wire or the like.

The present invention can produce the following effects by the construction described above.

The throttle unit of the engine according to the first aspect of the present invention includes suction passages from an air cleaner to the respective combustion chambers of a multiple-cylinder engine, throttle valves disposed in the respective suction passages, and bypass passages bypassing the throttle valves. The bypass passage includes an inlet of the bypass passage in communication with the upstream side of the throttle valve of the suction passage, one valve body receiving chamber coaxial with the inlet of the bypass passage, a plurality of upstream side branch passages extending from the valve body receiving chamber, downstream side branch passages extending from the end portions of the upstream side branch passages and in communication with the downstream sides of the throttle valve of the suction passage. Furthermore, one valve body is movably received in the valve body receiving chamber. The valve body movable in the valve body receiving chamber in the direction away from the inlet of the bypass passage to open the plurality of upstream side branch passages at the same opening when the bypass passage is in an open position. By reducing the number of the valve bodies of the multiple-cylinder engine to one, it is possible to simplify a mechanism for activating the valve body and hence to reduce the manufacturing cost and the number of man hours for assembly of the throttle unit.

Furthermore, during the control by the one valve body, suction air tends not to be sucked into one cylinder from the other cylinder by a difference in negative pressure between the respective cylinders. By controlling the openings of the plurality of branch passages at the same opening, it is possible to make the total sum of the opening areas of the branch passages smaller than the passage area of the inlet side of the bypass passage at a time where the number of revolution of the engine is not more than 2000 rpm and tends to vary widely. Accordingly, it is possible to prevent the suction air from being sucked into one cylinder from the other cylinder and to reduce the effects on the variation in the number of revolutions of the engine. Therefore, it is possible to control the number of revolutions of the engine during idling with high accuracy In the throttle unit of an engine according to a second aspect of the present invention, the plurality of upstream side branch passages are formed on a line crossing at right angles and passing through the valve body receiving chamber. Therefore, it is possible to easily form the plurality of upstream side branch passages in one machining step and therefore reduce the time and cost of manufacturing.

In the throttle unit of an engine according to the third aspect of the present invention, the valve body receiving chamber has a diameter larger than the inlet of the bypass passage and the valve body is butted against the end portion between the valve body receiving chamber and the inlet of the bypass passage to completely close the bypass passage. Therefore, it is possible to minimize the amount of air leakage when the bypass passages are completely closed and therefore more correctly conduct suction control except when the engine is being started.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A throttle unit for a multiple-cylinder engine, comprising:

a plurality of suction passages, said plurality of suction passages being extendable from an air cleaner to respective combustion chambers of the multiple-cylinder engine;

a plurality of throttle valves, each of said plurality of throttle valves being disposed in said plurality of suction passages, respectively; and a bypass passage for bypassing said plurality of throttle valves, said bypass passage comprising:

an inlet, said inlet being in communication with an upstream side of said plurality of throttle valves;

a valve body receiving chamber, said valve body receiving chamber being coaxial with said inlet;

a plurality of upstream side branch passages, each of said plurality of upstream side branch passages extending from said valve body receiving chamber;

a plurality of downstream side branch passages, each of said downstream side branch passages extending from end portions of said plurality of upstream side branch passages, respectively, each of said downstream side branch passages being in communication with a downstream side of said plurality of throttle valves; and a valve body movably received in said valve body receiving chamber for opening and closing said bypass passage, said valve body being movable in a direction away from said inlet to open said plurality of upstream side branch passages at the same opening quantity when said bypass passage is in an open condition.

2. The throttle unit for a multiple-cylinder engine according to claim 1, wherein each of said plurality of upstream side branch passages have an axis crossing an axis of said valve body receiving chamber at generally a right angle.

3. The throttle unit for a multiple-cylinder engine according to claim 1, wherein said valve body receiving chamber has a diameter larger than said inlet and wherein said valve body is abutted against a stepped portion between said valve body receiving chamber and said inlet to completely close the bypass passage when said valve body is in a closed position.

4. The throttle unit for a multiple-cylinder engine according to claim 2, wherein said valve body receiving chamber has a diameter larger than said inlet and wherein said valve body is abutted against a stepped portion between said valve body receiving chamber and said inlet to completely close the bypass passage when said valve body is in a closed position.

5. The throttle unit for a multiple-cylinder engine according to claim 1, further comprising a depressed portion formed on an air cleaner side of said throttle unit, said depressed portion being in communication with said inlet of said bypass passage and an upstream side of said plurality of suction passages.

6. The throttle unit for a multiple-cylinder engine according to claim 1, further comprising a plurality of depressed portions formed on a combustion chamber side of said throttle unit, said plurality of depressed portions being in communication with said plurality of downstream side branch passages, respectively, and a downstream side of said plurality of suction passages.

7. The throttle unit for a multiple-cylinder engine according to claim 1, wherein said plurality of downstream side branch passages are parallel to said valve body receiving chamber, and said plurality of upstream side branch passages are generally at a right angle to said plurality of downstream side branch passages and said valve body receiving chamber.

8. The throttle unit for a multiple-cylinder engine according to claim 1, further comprising a valve body driving mechanism for driving said valve body from an open to a closed position to open and close said bypass passage.

9. The throttle unit for a multiple-cylinder engine according to claim 1, wherein said bypass passage includes only one of said valve body receiving chamber and only one of said valve body, wherein operation of said one valve body opens and closes each of said plurality of upstream side branch passages at the same opening quantity when said one valve body is in a closed position.

10. A bypass passage for a throttle unit of a multiple-cylinder engine, said throttle unit including a plurality of suction passages extending from an air cleaner to respective combustion chambers of the multiple-cylinder engine and a plurality of throttle valves disposed in the plurality of suction passages, respectively, said bypass passage for bypassing the plurality of throttle valves and comprising:

an inlet, said inlet for being in communication with an upstream side of the plurality of throttle valves;

a valve body receiving chamber, said valve body receiving chamber being coaxial with said inlet;

a plurality of upstream side branch passages, each of said plurality of upstream side branch passages extending from said valve body receiving chamber;

a plurality of downstream side branch passages, each of said downstream side branch passages extending from end portions of said plurality of upstream side branch passages, respectively, each of said downstream side branch passages for being in communication with a downstream side of the plurality of throttle valves; and a valve body movably received in said valve body receiving chamber for opening and closing said bypass passage, said valve body being movable in a direction away from said inlet to open said plurality of upstream side branch passages at the same opening quantity when said bypass passage is in an open condition.

11. The bypass passage for a throttle unit of a multiple-cylinder engine according to claim 10, wherein each of said plurality of upstream side branch passages have an axis crossing an axis of said valve body receiving chamber at generally a right angle.

12. The bypass passage for a throttle unit of a multiple-cylinder engine according to claim 10, wherein said valve body receiving chamber has a diameter larger than said inlet and wherein said valve body is abutted against a stepped portion between said valve body receiving chamber and said inlet to completely close the bypass passage when said valve body is in a closed position.

13. The bypass passage for a throttle unit of a multiple-cylinder engine according to claim 11, wherein said valve body receiving chamber has a diameter larger than said inlet and wherein said valve body is abutted against a stepped portion between said valve body receiving chamber and said inlet to completely close the bypass passage when said valve body is in a closed position.

14. The bypass passage for a throttle unit of a multiple-cylinder engine according to claim 10, wherein said plurality of downstream side branch passages are parallel to said valve body receiving chamber, and said plurality of upstream side branch passages are generally at a right angle to said plurality of downstream side branch passages and said valve body receiving chamber.

15. The bypass passage for a throttle unit of a multiple-cylinder engine according to claim 10, further comprising a valve body driving mechanism for driving said valve body from an open to a closed position to open and close said bypass passage.

16. The bypass passage for a throttle unit of a multiple-cylinder engine according to claim 1, wherein said bypass passage includes only one of said valve body receiving chamber and only one of said valve body, wherein operation of said one valve body opens and closes each of said plurality of upstream side branch passages at the same opening quantity when said one valve body is in a closed position.

* * * * *